US008944877B2

(12) United States Patent
Higuchi

(10) Patent No.: US 8,944,877 B2
(45) Date of Patent: Feb. 3, 2015

(54) ACTION TOY WITH JET PACK

(75) Inventor: Terence Higuchi, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 659 days.

(21) Appl. No.: 13/113,631

(22) Filed: May 23, 2011

(65) Prior Publication Data

US 2011/0294393 A1 Dec. 1, 2011

Related U.S. Application Data

(60) Provisional application No. 61/349,482, filed on May 28, 2010.

(51) Int. Cl.

| | |
|---|---|
| ***A63H 3/00*** | (2006.01) |
| ***A63H 33/40*** | (2006.01) |
| ***A63H 3/36*** | (2006.01) |
| *A63H 27/00* | (2006.01) |

(52) U.S. Cl.

CPC ..... *A63H 3/36* (2013.01); *A63H 33/40* (2013.01); *A63H 27/005* (2013.01)

USPC ..... 446/268; 446/330

(58) Field of Classification Search

USPC ..... 446/275, 308, 314, 320, 321, 330, 331, 446/376

See application file for complete search history.

(56) References Cited

U.S. PATENT DOCUMENTS

| | | | | |
|---|---|---|---|---|
| 1,824,388 | A | 2/1930 | Birch | |
| 2,042,270 | A * | 5/1936 | Moore et al. | 446/51 |
| 2,219,311 | A * | 10/1940 | Hammond et al. | 446/51 |
| 2,277,882 | A * | 3/1942 | Quady | 446/51 |
| 3,531,890 | A | 10/1970 | Citron et al. | |
| 4,008,541 | A * | 2/1977 | Russer | 446/51 |
| 4,536,166 | A * | 8/1985 | Renger et al. | 446/298 |
| 4,654,018 | A * | 3/1987 | Farrington et al. | 446/38 |
| 4,902,262 | A * | 2/1990 | Lunsford | 446/268 |
| 4,965,707 | A | 10/1990 | Butterfield | |
| 5,588,895 | A | 12/1996 | Larson | |
| 5,730,638 | A | 3/1998 | Ward | |
| 6,165,037 | A | 12/2000 | Van Zant | |
| 6,302,555 | B1 | 10/2001 | Bristow | |
| 6,461,011 | B1 | 10/2002 | Harrison | |
| 6,554,443 | B2 * | 4/2003 | Fan | 362/96 |
| 6,699,094 | B1 | 3/2004 | Ward | |
| 6,955,440 | B2 | 10/2005 | Niskanen | |
| 6,997,772 | B2 | 2/2006 | Fong | |
| 7,093,949 | B2 | 8/2006 | Hart et al. | |
| 7,300,179 | B1 | 11/2007 | LaDuke et al. | |
| 7,556,408 | B2 | 7/2009 | Thomson | |
| 2002/0080601 | A1 | 6/2002 | Meltzer | |
| 2002/0094746 | A1 | 7/2002 | Harlev | |
| 2002/0152655 | A1 | 10/2002 | Merrill et al. | |

(Continued)

*Primary Examiner* — Gene Kim
*Assistant Examiner* — Joseph B Baldori
(74) *Attorney, Agent, or Firm* — Cantor Colburn LLP

(57) ABSTRACT

A toy having a humanoid body and a jet pack is provided. The toy includes a first fabric portion partially ejected from a first aperture in the jet pack in response to a lever being moved from a first position to a second position. The toy further includes a fan disposed in the body that blow airs across the first fabric portion. The toy further includes a first light emitting diode that illuminates the first fabric portion when the first fabric portion is partially ejected from the first aperture such that the first fabric portion simulates flames being emitted from the jet pack.

20 Claims, 5 Drawing Sheets

(56) References Cited

U.S. PATENT DOCUMENTS

| | | | | |
|---|---|---|---|---|
| 2002/0170215 | A1 | 11/2002 | Mix et al. | |
| 2003/0053305 | A1 | 3/2003 | Lin | |
| 2003/0126775 | A1 | 7/2003 | Corry et al. | |
| 2004/0181983 | A1 | 9/2004 | Hess et al. | |
| 2005/0075041 | A1* | 4/2005 | Norman | 446/310 |
| 2005/0086841 | A1 | 4/2005 | Schroeter et al. | |
| 2005/0155262 | A1 | 7/2005 | Mix et al. | |
| 2005/0191936 | A1 | 9/2005 | Marine et al. | |
| 2005/0239367 | A1 | 10/2005 | Fernandez, Jr. | |
| 2006/0034100 | A1 | 2/2006 | Schnuckle et al. | |
| 2006/0098428 | A1 | 5/2006 | Rosserot | |
| 2006/0188831 | A1 | 8/2006 | Hess et al. | |
| 2006/0270307 | A1* | 11/2006 | Montalvo et al. | 446/64 |
| 2006/0292963 | A1* | 12/2006 | Sun et al. | 446/268 |
| 2006/0292964 | A1 | 12/2006 | Rosella, Jr. et al. | |
| 2009/0074390 | A1 | 3/2009 | Power et al. | |
| 2009/0075555 | A1 | 3/2009 | Barthold | |
| 2009/0126241 | A1 | 5/2009 | Asofsky | |

* cited by examiner

ACTION TOY WITH JET PACK

BACKGROUND

The present invention relates to a toy, and in particular a toy having a humanoid shape.

Toys having humanoid shapes or figures have been developed. People enjoy engaging in play with these types of toys to simulate action-hero types of activities. People also desire to play with toys that have several play options. It is therefore desirable to provide people with toys that both simulate activities that they are not able to participate in themselves while also stimulating their imaginations. One way of increasing the available play options is to provide toys with movable components or which facilitate the simulation of imaginary situations, such as having flames exiting one or more vehicles such as a plane or other flying device.

Accordingly, while existing toy figures are suitable for their intended purposes, it is desirable to provide a toy or action figure with a humanoid shape having a jet pack with simulated flames exiting the jet pack.

SUMMARY OF THE INVENTION

A toy in accordance with an exemplary embodiment is provided. The toy includes a humanoid body and a jet pack attached to the humanoid body. The toy further includes a first fabric portion being partially ejected from a first aperture in the jet pack in response to a lever being moved from a first position to a second position. The toy further includes a fan disposed in the humanoid body configured to blow air through a second aperture in the jet pack across the first fabric portion when a switch has a first operational position. The toy further includes a first light emitting diode disposed on the jet pack configured to illuminate the first fabric portion when the switch has the first operational position and the first fabric portion is partially ejected from the first aperture such that the first fabric portion simulates flames being emitted from the jet pack.

In another exemplary embodiment, a jet pack configured for use with an action figure is provided. The jet pack includes a housing portion. A first fabric portion is arrange to be partially ejected from a first aperture in the housing portion in response to a lever being moved from a first position to a second position. A fan is disposed in the humanoid body and configured to blow air through a second aperture in the housing portion across the first fabric portion when a switch has a first operational position. A first light emitting diode is disposed on the housing configured to illuminate the first fabric portion when the switch has the first operational position and the first fabric portion is partially ejected from the first aperture such that the first fabric portion simulates flames being emitted from the housing of the jet pack.

In yet another exemplary embodiment, a toy is provided having a humanoid body. A housing is coupled to one side of the humanoid body, the housing having a first aperture and a second aperture. A first fabric portion is movably coupled to the housing. A lever is operably coupled to the first fabric portion to move the first fabric portion from the first position to a second position, wherein the first fabric portion extends at least partially through the first aperture when in the second position. A fan is operably coupled to move air through the second aperture. A switch is coupled to fan. At least one first light emitting diode disposed on the housing to direct light onto the first fabric portion when the first fabric portion is in the second position.

BRIEF DESCRIPTION OF THE DRAWINGS

Other features, advantages and details appear, by way of example only, in the following description of embodiments, the description referring to the drawings in which.

DETAILED DESCRIPTION

Figure 10:
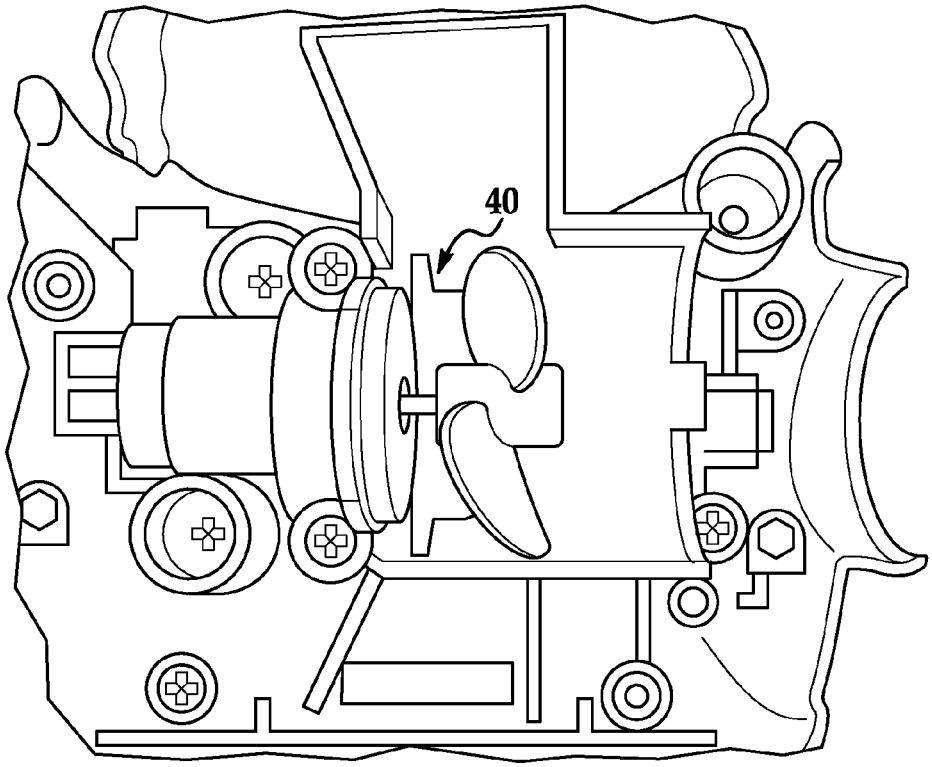
FIG. 10 is a schematic of a fan utilized in the toy of FIG. 1.

Referring to the FIGS. and in particular to FIGS. 1-4, 8-8C and 11, a toy or action FIG. 10 in accordance with an exemplary embodiment is provided. The toy or action FIG. 10 includes a body portion 20 which in one non-limiting exemplary embodiment resembles a humanoid body or course numerous other configurations are contemplated to be within the scope of exemplary embodiments of the present invention non-limiting examples include creatures, aliens, humans, humanoids, robots, story characters or any other type of configuration.

The toy also includes a jet pack 22, a movable assembly 24, a rod 25, a lever 26, fabric portions 32, 34, a fan 40, a battery or batteries 42, 44, 46, a switch 50, and light emitting diodes (LEDs) 52, 54. In one non-limiting exemplary embodiment, the fabric portions of are die-cut fabric or flame-shaped fabric configured to have a consistency or weave count to make it light enough to be moved by the fan and simulate the flame effect. Non-limiting examples of suitable fabrics are nylon, plastic, having no coatings or a metallic-effect, metallic coating or metallic ink dyed thereon to provide a metallic fabric portion as long as the weight is light enough to allow for the desired flame effect. Still further the fabric portion may be of any suitable color to provide the desired effect in combination with the illumination provided by the LEDs.

An advantage of the toy 10 is that the toy utilizes air from the fan 40 to move illuminated fabric portions 32, 34 to simulate flame being emitted from the jet pack 22.

Figure 1:
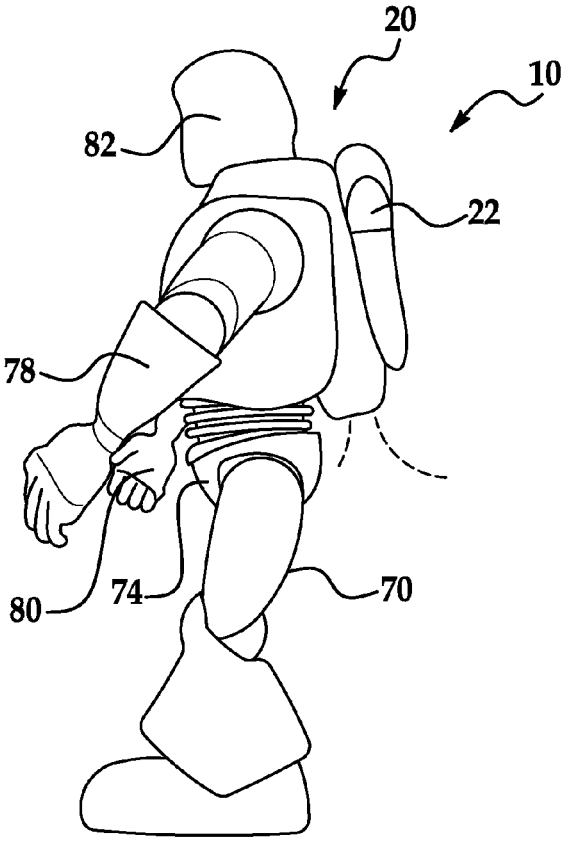
FIG. 1 is a side view of a toy in accordance with an exemplary embodiment.
Figure 2:
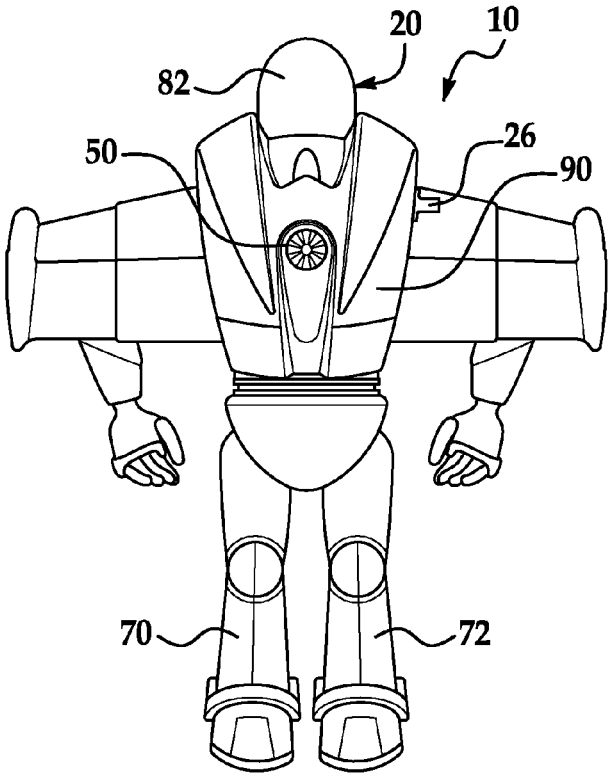
FIG. 2 is a rear view of the toy of FIG. 1.
Figure 3:
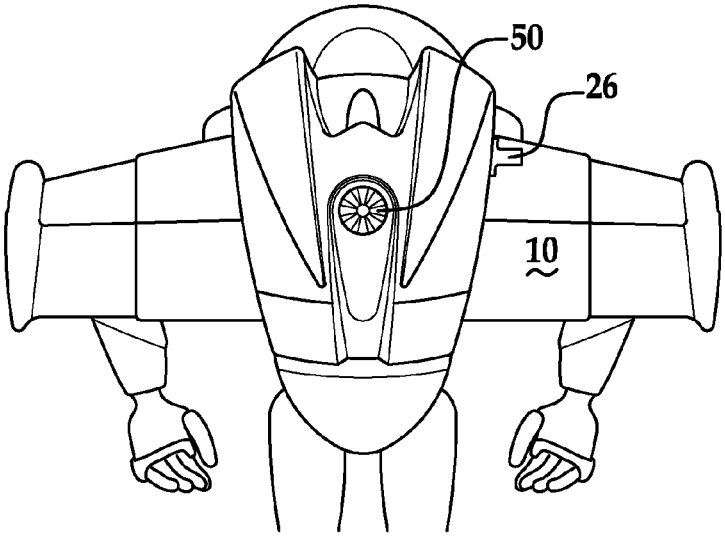
FIG. 3 is an enlarged rear view of a portion of the toy of FIG. 1.

Referring to FIGS. 1 and 2 and in one non-limiting embodiment, the humanoid body 20 includes legs 70, 72, a torso 74, a chest 76, arms 78, 80, and a head 82. The legs 70, 72 are coupled to the torso 74, and the torso 74 is coupled between the legs 70, 72 and the chest 76. The arms 78, 80 are disposed on opposite sides of the chest 76. Finally, the head 82 is coupled to an upper portion of the chest 76.

Referring to FIGS. 2, 4 and 6-9 and in one non-limiting embodiment, the jet pack 22 includes a wing assembly portion 89 and an outer cover 90. Of course, the jet pack can be configured to not have a wing assembly portion. The wing assembly portion 89 is coupled to a rear portion of the chest 76 of the humanoid body 20. The outer cover 90 is coupled to the wing assembly portion 89, and the cover 90 and the portion 89 define an interior region therebetween. The outer cover 90 includes holding portions 108, 110 for holding the rod 25 therebetween as will be described in greater detail below. The jet pack 22 includes apertures 102, 104, 106 extending therethrough. The apertures 102, 104 are configured to allow the fabric portions 32, 34 to extend therethrough. The aperture 106 is configured to allow air to flow from the fan 40, disposed in the humanoid body 20, onto the fabric portions 32, 34 disposed through the apertures 102, 104 to simulate flame movement.

Figure 4:
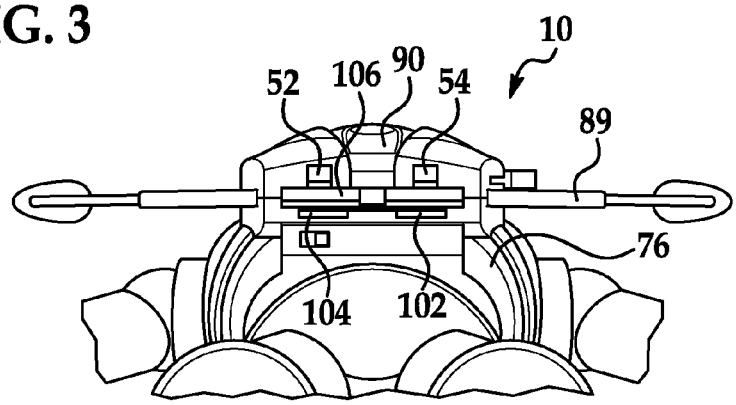
FIG. 4 is a bottom view of the toy of FIG. 1.
Figure 5:
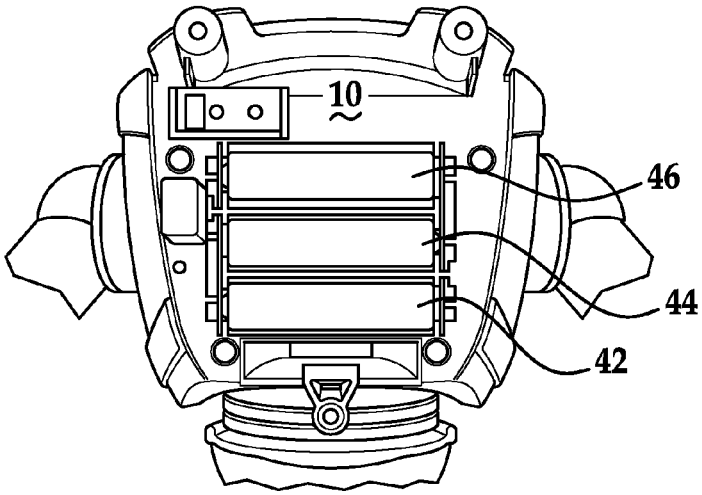
FIG. 5 is a schematic of an interior region of the toy of FIG. 1.
Figure 6:
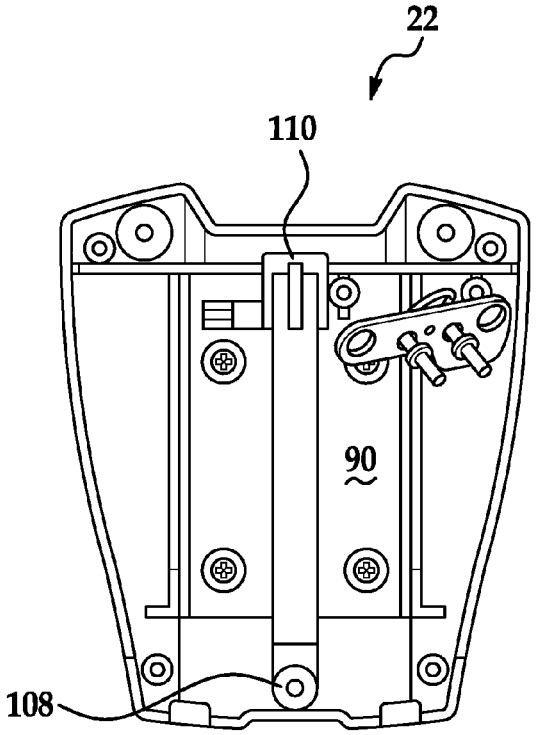
FIG. 6 is a schematic of an outer cover of a jet pack in the toy of FIG. 1.
Figure 7:
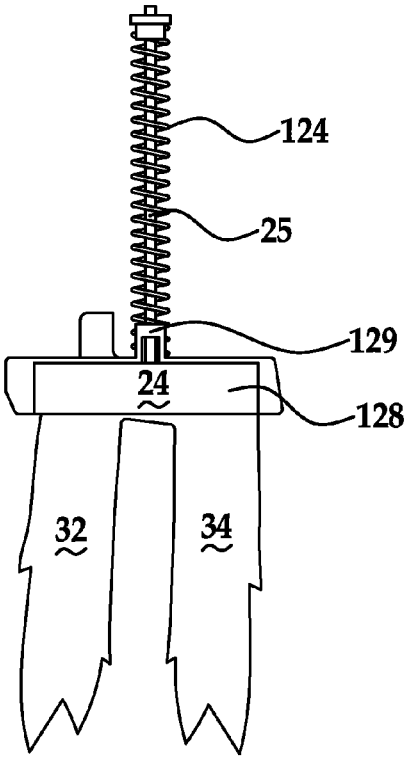
FIG. 7 is a schematic of a movable assembly utilized in the toy of FIG. 1.
Figure 8:
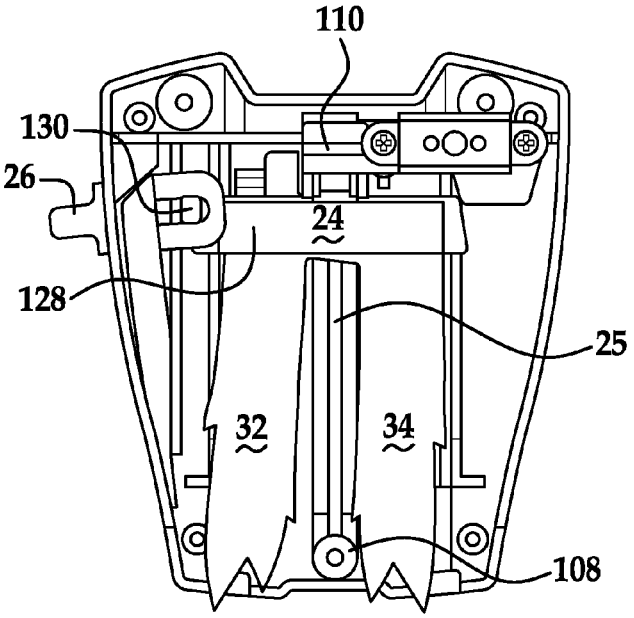
FIG. 8 is a schematic of the outer cover of the jet pack of FIG. 6 holding the movable assembly of FIG. 7 therein.
Figure 8A:
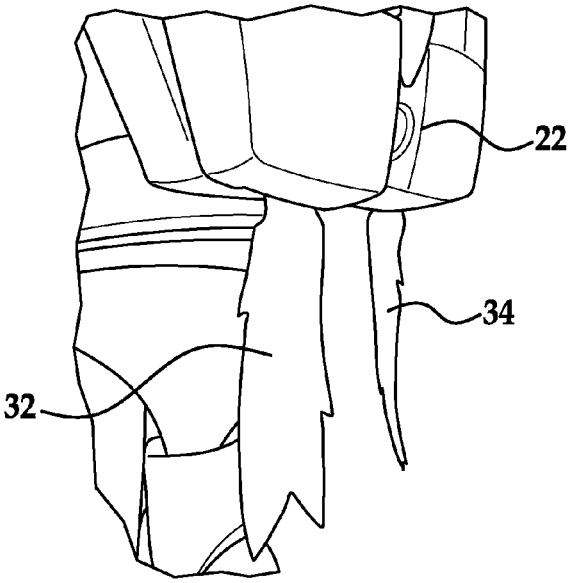
FIGS. 8A and 8B are views of the jet pack of an exemplary embodiment of the present invention.
Figure 8B:
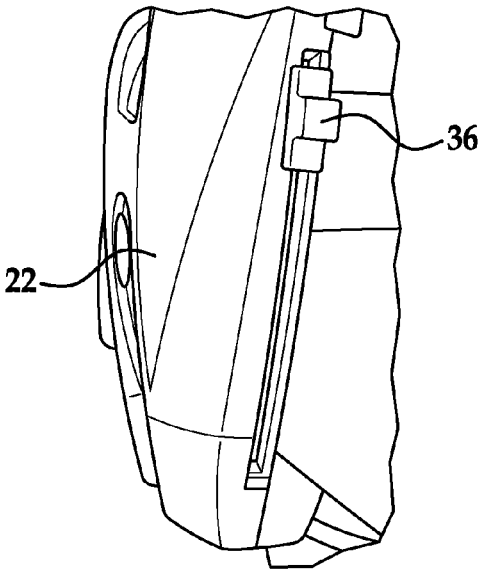
Figure 9:
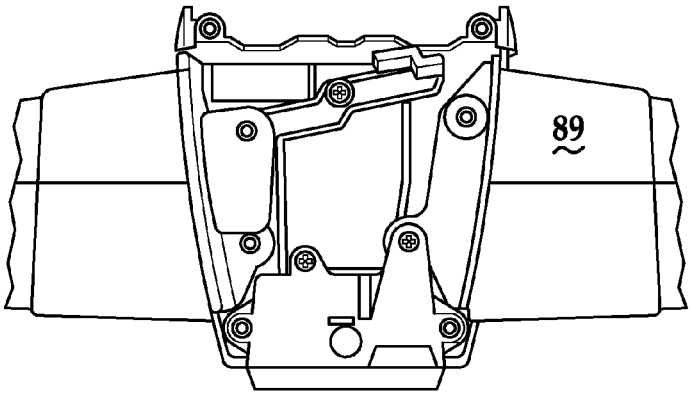
FIG. 9 is a schematic of a wing assembly of a jet pack in the toy of FIG. 1.

Referring to FIGS. 4, 7 and 8, the movable assembly 24 is configured to move the fabric portions 32, 34 from an interior region of the jet pack 22 through the apertures 102, 104 such that the fabric portions 32, 34 are substantially outside of the jet pack 22, and vice versa. In one non-limiting exemplary embodiment, the movable assembly 24 includes a plate 128, a tubular portion 129, and a tab portion 130. The tubular portion 129 is attached to a central region of the plate 128. The tab portion 130 is coupled at an end of the plate 128 and is operably coupled to the lever 26. The tubular portion 129 is slidably received on the elongated rod 25, which is held between the holding portions 108, 110 of the outer cover 90. Also, the plate 128 is attached to the fabric portions 32, 34. The spring 124 is disposed on the elongated rod 25 between the first end of the rod 25 and the tubular portion 129 and biases the plate 128 and fabric portions 32, 34 toward the apertures 102, 104, respectively, in the jet pack 22.

During operation and when the lever 26 is moved from a first position (shown in FIG. 3) to a second position (shown in FIG. 2), the lever 26 moves the moveable assembly 24 downwardly along the elongated rod 25 such that the fabric portions 32, 34 are moved from an interior region of the jet pack 22 through the apertures 102, 104 to a region outside of the jet pack 22. Alternately and when the lever 26 is moved from the second position (shown in FIG. 2) to the first position (shown in FIG. 3), the lever 26 moves the moveable assembly 24 upwardly along the elongated rod 25 such that the fabric portions 32, 34 are moved through the apertures 102, 104 from the region outside of the jet pack 22 into the interior region of the jet pack 22. Further, the moveable assembly 24 is configured to move a switch 50 (shown in FIG. 3) to a open operational position when the moveable assembly 24 is at a full upward position (as shown in FIG. 8) and the lever 26 is at the first position (shown in FIG. 8).

Figure 11:
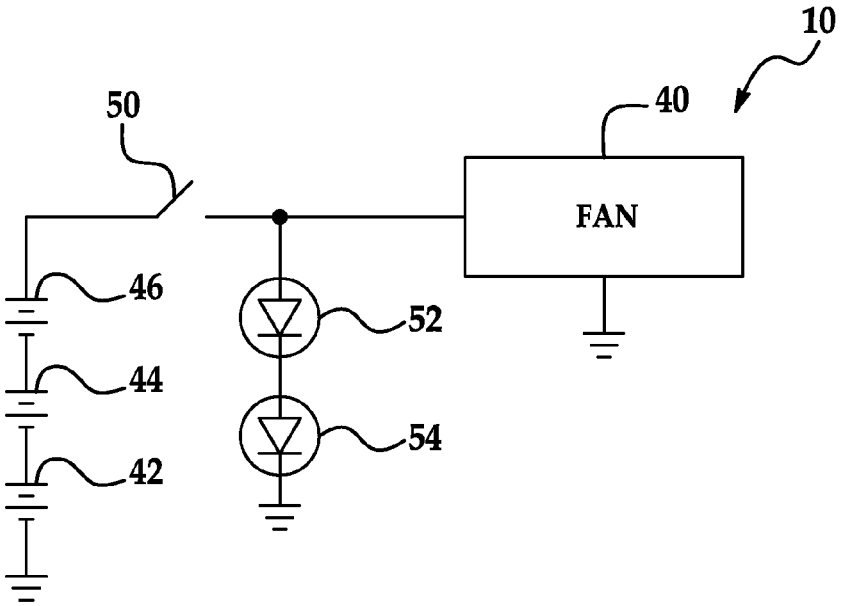
FIG. 11 is a diagram of electrical components utilized in the toy of FIG. 1; and Appendix A illustrates an exemplary embodiment of the present invention.

Referring to FIG. 11, a circuit having the electrical components of the toy 10 will now be described. The circuit includes a power supply such as a battery or batteries 42, 44, 46, the switch 50, the fan 40, and the LEDs 52, 54. The batteries 42, 44, 46 are electrically coupled in series between the switch 50 and electrical ground. The switch 50 is electrically coupled between the batteries and the fan 40. The fan 40 is further electrically coupled to electrical ground. Also, the LEDs 52 and 54 are electrically coupled in series between the switch 50 and electrical ground.

Referring to FIGS. 4, 10 and 11, during operation, when the switch 50 is moved from an open operational position to a closed operational position by an operator, a voltage from the batteries 42, 44, 46 is applied to a motor of the fan 40 to turn on the fan 40. Air from the fan 40 blows through the aperture 106 to cause the fabric portions 32, 34 to have fluttering movement. Further, the voltage is applied across the LEDs 52, 54 and in response the LEDs 52, 54 illuminate the fabric portions 32, 34 when the portions 32, 34 are positioned substantially outside of the jet pack 22 such that the portions 32, 34 simulate flame being emitted from the jet pack 22.

Alternately, when the switch 50 is moved from the closed operational position to the open operational position, a voltage from the batteries 42, 44, 46 is removed from the motor of the fan 40 to turn off the fan 40. Further, the voltage is removed from the LEDs 52, 54 to turn off the LEDs 52, 54. Further, the movable assembly 24 is configured to move the switch 52 from the closed operational position to the open operational position when the lever 26 is moved from the second position (shown in FIG. 2) to the first position (shown in FIG. 3) to turn off both the fan 40 and LEDs 52, 54.

The toy 10 provides a substantial advantage over other toys. In particular, the toy 10 provides a technical effect of ejecting fabric portions from a jet pack and blowing air across the fabric portions while the fabric portions are illuminated to simulate flames being emitted from the jet pack.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A toy, comprising:

a humanoid body;

a toy jet pack attached to the humanoid body;

a first fabric portion being partially ejected from a first aperture in a housing of the toy jet pack in response to a lever being moved from a first position to a second position;

a fan disposed in the humanoid body configured to blow air through a second aperture in the housing of the toy jet pack across the first fabric portion when a switch has a first operational position; and a first light emitting diode disposed on the toy jet pack configured to illuminate the first fabric portion when the switch has the first operational position and the first fabric portion is partially ejected from the first aperture such that the first fabric portion simulates flames being emitted from the toy jet pack.

2. The toy of claim 1, further comprising a movable assembly disposed in the toy jet pack, the movable assembly coupled to the first fabric portion and further coupled to the lever, the movable assembly moving the first fabric portion from inside the toy jet pack through the first aperture of the toy jet pack when the lever is moved from the first position to the second position.

3. The toy of claim 2, further comprising a second fabric portion coupled to the movable assembly.

4. The toy of claim 3, further comprising a second light emitting diode disposed on the toy jet pack configured to illuminate the second fabric portion when the second fabric portion is partially ejected from a third aperture in the toy jet pack and the switch has the first operational position.

5. The toy of claim 1, further comprising a battery, the switch being electrically coupled between the battery and the fan.

6. The toy of claim 5, wherein the switch is further electrically coupled between the battery and the light emitting diode.

7. The toy of claim 5, further comprising an elongated rod having first and second ends that is disposed in the toy jet pack and a spring, wherein the movable assembly includes a tubular portion attached to a plate, the tubular portion being slidably received on the elongated rod, the plate being further attached to the first fabric portion, the spring being disposed on the elongated rod between the first end of the rod and the tubular portion to bias the plate and first fabric portion toward the first aperture in the toy jet pack.

8. The toy of claim 7, wherein the movable assembly is configured to move the switch from the first operational position to a second operational position when the lever is moved from the second position to the first position to turn off both the fan and the first light emitting diode.

9. A toy jet pack configured for use with an action figure, the toy jet pack comprising:

a housing portion;

a first fabric portion being partially ejected from a first aperture in the housing portion in response to a lever being moved from a first position to a second position;

a fan disposed in the humanoid body configured to blow air through a second aperture in the housing portion across the first fabric portion when a switch has a first operational position; and a first light emitting diode disposed on the housing configured to illuminate the first fabric portion when the switch has the first operational position and the first fabric portion is partially ejected from the first aperture such that the first fabric portion simulates flames being emitted from the housing of the toy jet pack.

10. The toy jet pack of claim 9, further comprising a movable assembly disposed in the housing, the movable assembly coupled to the first fabric portion and further coupled to the lever, the movable assembly moving the first fabric portion from inside the housing through the first aperture of the toy jet pack when the lever is moved from the first position to the second position.

11. The toy jet pack of claim 10, further comprising a second fabric portion coupled to the movable assembly.

12. The toy jet pack of claim 11, further comprising a second light emitting diode disposed on the housing configured to illuminate the second fabric portion when the second fabric portion is partially ejected from a third aperture in the housing and the switch has the first operational position.

13. The toy jet pack of claim 9, further comprising a battery, the switch being electrically coupled between the battery and the fan.

14. The toy jet pack of claim 13, wherein the switch is further electrically coupled between the battery and the light emitting diode.

15. The toy jet pack of claim 4, further comprising an elongated rod having first and second ends that is disposed in the housing and a spring, wherein the movable assembly includes a tubular portion attached to a plate, the tubular portion being slidably received on the elongated rod, the plate being further attached to the first fabric portion, the spring being disposed on the elongated rod between the first end of the rod and the tubular portion to bias the plate and first fabric portion toward the first aperture in the housing.

16. The toy jet pack of claim 15, wherein the movable assembly is configured to move the switch from the first operational position to a second operational position when the lever is moved from the second position to the first position to turn off both the fan and the first light emitting diode.

17. A toy comprising:

a humanoid body;

a housing coupled to one side of the humanoid body, the housing having a first aperture and a second aperture;

a first fabric portion movably coupled to the housing;

a lever operably coupled to the first fabric portion to move the first fabric portion from the first position to a second position, wherein the first fabric portion extends at least partially through the first aperture when in the second position;

a fan operably coupled to move air through the second aperture;

a switch coupled to fan; and at least one first light emitting diode disposed on the housing to direct light onto the first fabric portion when the first fabric portion is in the second position.

18. The toy of claim 17 further comprising:

a movable assembly arranged within the housing and coupled to the first fabric portion and the lever, wherein the moveable assembly moves the first fabric portion from the first position to the second position in response to the movement of the lever; and a second fabric portion coupled to the movable assembly;

wherein the housing includes a third aperture and the second fabric portion is arranged to extend at least partially through the third aperture when the first fabric portion is in the second position.

19. The toy of claim 18 wherein the at least one light emitting diode includes a first light emitting diode arranged to illuminate the first fabric portion when the first fabric portion is in the second position and a second light emitting diode arranged to illuminate the second fabric portion when the first fabric portion is in the second position.

20. The toy of claim 18 further comprising:

a battery electrically coupled to the fan and the at least one light emitting diode; and a switch electrically coupled between the battery and the fan.

* * * * *